US005427551A

United States Patent [19]

Kameyama

[11] Patent Number: 5,427,551

[45] Date of Patent: Jun. 27, 1995

[54] REAR HOLDER FOR CONNECTOR

[75] Inventor: Isao Kameyama, Shizuoka, Japan

[73] Assignee: Yazaki Corporation, Tokyo, Japan

[21] Appl. No.: 210,465

[22] Filed: Mar. 21, 1994

[30] Foreign Application Priority Data

Mar. 19, 1993 [JP] Japan ..... 5-018138 U

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,308,265 5/1994 Kaneko ..... 439/752

5,322,457 6/1994 Tsuji et al. ..... 439/752

FOREIGN PATENT DOCUMENTS 1-139374 9/1989 Japan .

*Primary Examiner*—Gary F. Paumen

*Attorney, Agent, or Firm*—Sughrue, Mion, Zinn, Macpeak & Seas

[57] ABSTRACT

A rear holder usable for both a female connector housing and a male connector housing includes a plurality of partition pieces each extending in a transverse direction at a right angle relative to cables, causing a plurality of partition slots to be formed between adjacent partition pieces with a predetermined distance held therebetween. Engagement pawls adapted to be engaged with engagement holes or recesses formed through a wall of the connector housing are formed at foremost ends of the partition pieces. To assure that a single kind of rear holder can be used for both of the female connector housing and the male connector housing, the engagement pawls are arranged in a zigzag-shaped pattern as viewed from one side. In practice, when the rear holder is used for the female connector housing, it is fitted to the latter while one side of the rear holder having stepped parts formed thereon faces stepped parts of the female connector housing. When the rear holder is used for the male connector housing, it is inverted so as to allow the other side of the rear holder having a flat surface to be fitted to a rear holder receiving chamber of the male connector housing having stepped part formed thereon.

9 Claims, 2 Drawing Sheets

REAR HOLDER FOR CONNECTOR

BACKGROUND OF THE INVENTION

The present invention relates generally to a rear holder for a connector. More particularly, the present invention relates to a rear holder which can be used on both a female connector housing and a male connector housing for use in a so-called hybrid connector having plural kinds of terminals, each being of the same size and each immovably received in terminal receiving chambers in a connected state relative to opponent cables.

A rear holder for a connector includes a plurality of partition pieces corresponding to an arrangement of plural kinds of terminals immovably received in terminal receiving chambers in a connected state relative to opponent cables, and each partition piece defines a row of cables connected to the terminals. In addition, the rear holder is used for preventing the terminals from being disconnected from the connector housing in a rearward direction while the rear holder is fitted to a rear end part of a female connector housing or a male connector housing.

A conventional rear holder of the foregoing type is practically employed in a so-called hybrid connector having plural kinds of terminals, each having a same size, received in terminal receiving chambers in a form of a single block in the connected state relative to opponent cables.

Specifically, this hybrid connector includes a connector housing in which terminal receiving chambers having terminals connected to large size cables received therein and terminal receiving chambers having terminals connected to small size cables received therein are formed. Since the length of each terminal having a large diameter is different from the length of each terminal having a small diameter, stepped parts are formed in a rear holder receiving chamber for receiving a rear holder corresponding to the sizes of the terminals. On the other hand, the rear holder is designed to exhibit a contour coincident with that of the stepped parts on the housing 1 side so as to allow the rear holder to be fitted into the rear holder chamber. With this construction, desired effects expected from the connector are effectively obtainable by fitting the rear holder into the rear holder receiving chamber.

To assure that malfunctions do not arise, such as the connected terminals being disconnected from the connector housing in the rearward direction or the terminals being incorrectly inserted into the corresponding terminal receiving chamber, the rear holder is designed to exhibit a contour coincident with that of each stepped part on the housing side in the above-described manner. For this reason, in cases where the contour of each stepped part varies to some extent, especially in the case where the contour of a fitting portion on the female connector housing or the male connector housing is modified, there arises a necessity for fabricating another rear holder to cope with the foregoing variation or modification.

Consequently, the number of dies for molding rear holders is increased, resulting in an undesirably increased production cost for each connector housing. In addition, other problems include: the amount of time required for achieving a preparative operation is increased due to an increase in the number of components in the final state of the connector housing assembled with the rear holder, an inventory controlling operation for storing various kinds of components becomes complicated, and the production cost of each molded article is substantially increased.

In the case where the rear holder is employed with a connector having a special contour, the rear holder cannot be practically used as a common component irrespective of the contour of each stepped part on the connector housing side.

SUMMARY OF THE INVENTION

The present invention has been made in consideration of the aforementioned background.

An object of the present invention is to provide a rear holder for a connector which can be used on a common basis, irrespective of the contour of each stepped part on the connector housing side, as well as a special contour of the connector housing itself.

Another object of the present invention is to provide a rear holder of the foregoing type which assures that an increase in the number of components associated with fabrication of the rear holder can be suppressed as far as possible.

The present invention provides a rear holder for a connector including a plurality of partition pieces corresponding to an arrangement of terminal receiving chambers each having a plurality of terminals received therein in a connected state relative to opponent cables, the rear holder being fitted to a rear end part of a female connector housing or a male connector housing for preventing the terminals from being disconnected from the female connector housing or the male connector housing, wherein the rear holder is characterized in that the rear holder includes a front surface contour and a rear surface contour each of which is coincident with that of the rear end part of the female connector housing or the rear end part of the male connector housing, and that the rear holder is inverted at a time of fitting the rear holder to the female connector housing or the male connector housing so as to enable the rear holder to be used for both the female connector housing and the male connector housing.

With the rear holder constructed in the above-described manner, since the front and rear surfaces of the rear holder are formed to assume contours coincident with those of the rear end parts of the female connector housing and the male connector housing to cooperate with each other in the form of a pair, when the rear holder is fitted to the female connector housing, one side of the rear holder having stepped parts formed thereon faces the stepped parts of the female connector housing. When the rear holder is fitted to the male connector housing, the rear holder is inverted, causing an other side of the rear holder having a flat surface to be fitted into a rear holder receiving chamber of the male connector housing. Consequently, a single kind of rear holder can be used for both the female connector housing and the male connector housing.

Other objects, features and advantages of the present invention will become apparent from a reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

First, a rear holder for a connector constructed according to an embodiment of the present invention will be described below with reference to FIGS. 1–3.

Figure 1:
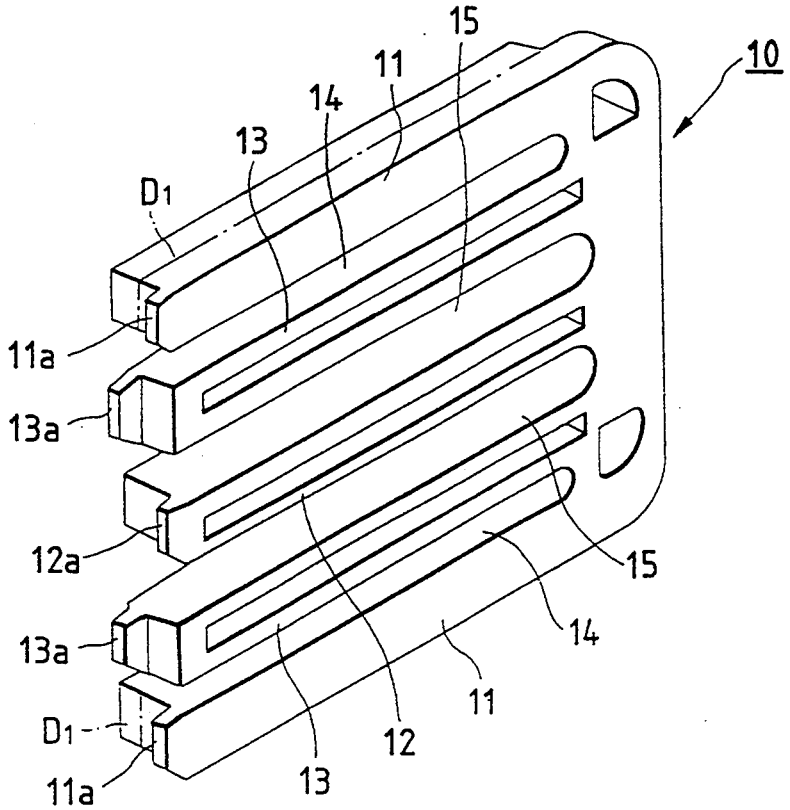
FIG. 1 is a perspective view of a rear holder for a connector constructed according to an embodiment of the present invention.
Figure 2:
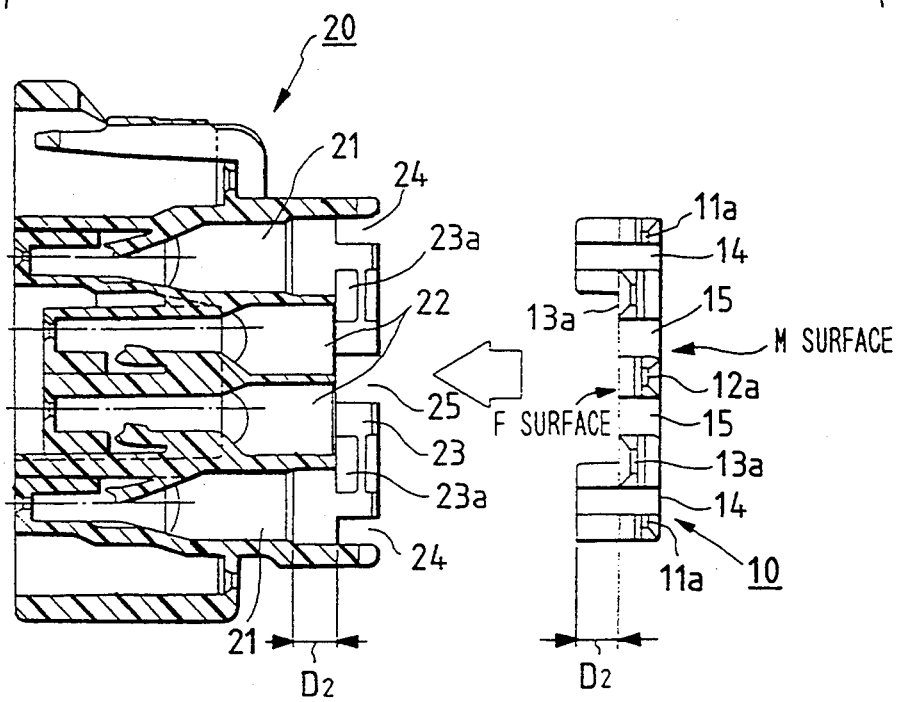
FIG. 2 is a sectional view of the rear holder shown in FIG. 1, particularly illustrating how the rear holder is fitted to a female connector housing.

FIG. 1 is a perspective view of the rear holder, and FIG. 2 is a sectional view of the rear holder prior to fitting of the rear holder to a female connector housing. In addition, FIG. 3 is a sectional view of the rear holder prior to fitting of the rear holder to a male connector housing.

In this embodiment, illustration is made with respect to the case that the rear holder is used in a so-called hybrid connector having plural different kinds of terminals, each having a same size, immovably received in a connected skate relative to opponent cables. However, for the purpose of convenience, the description below will be made on the assumption that a stepped part is not formed at a rear end Dart of the male connector housing or a very small stepped part is formed at the rear end part of the same in contrast with the female connector housing.

As is best seen in FIG. 1, the rear holder 10 includes a plurality of partition pieces 11, 12 and 13 (five partition pieces in the case shown) which are projected from a base portion 10*a* in a specific direction, i.e., in a leftward direction to exhibit a plow-shaped contour, and the partition pieces 12 and 13 are arranged in a spaced relationship between the opposite partition pieces 11 with a predetermined distance held between adjacent partition pieces. An elongated hollow space between the partition pieces 11 and 13 serves as a partition slit 14 for allowing a plurality of cables, each having a small diameter, to be inserted therethrough. Similarly, an elongated hollow space between the partition pieces 12 and 13 serves as a partition slit 15 for allowing a plurality of cables, each having a large diameter, to be inserted therethrough. While the cables are inserted through the partition slits 14 and 15, a plurality of terminals are connected to a rear end part of a female connector housing (hereinafter referred to simply as an F connector) 20 and a male connector housing (hereinafter referred to simply as an M connector) 30 shown in FIG. 2 and FIG. 3 without any possibility that the respective cables being erroneously inserted into the F connector 20 and the M connector 30. In other words, one object of the rear holder 10 is accomplished in the above-described manner and another object of the rear holder is accomplished by designing the rear holder 10 to have a substantially U-shaped contour as shown in FIG. 2 and FIG. 3.

Specifically, the rear holder 10 is designed such that, e.g., a front surface (hereinafter referred to simply as an F surface) of a large part of each partition piece 11 is projected to form a stepped part $D_1$ having a large thickness and a rear surface (hereinafter referred to simply as an M surface) of the rear holder 10 is kept flat.

With the F connector 20 shown in FIG. 2, a stepped part $D_2$ is formed in a rear holder receiving chamber 23 based on a difference between a size of each terminal connected to a cable having a small diameter to be inserted into each terminal receiving chamber 21 and a size of each terminal connected to a cable having a large diameter to be inserted into each terminal receiving chamber 22. Thus, when the rear holder 10 is received in the rear holder receiving chamber 23 while the F surface of the rear holder 10 faces the same, the rear holder 10 can be snugly fitted into the rear holder receiving chamber 23 while coming in close contact with the same because the stepped part $D_1$ of the rear holder 10 is dimensionally coincident with the stepped part $D_2$ of the rear holder receiving chamber 23. With this construction, there does not arise a malfunction where the terminals are disconnected from the F connector 20 in the rearward direction.

Engagement pawls 11*a*, 12*a* and 13*a* are formed at foremost ends of the partition pieces 11, 12 and 13, respectively, and engagement holes 23*a* are correspondingly formed through a wall of the rear holder receiving chamber 23, whereby the rear holder 10 can be immovably secured to the F connector 20 by bringing the engagement pawls 13*a* in engagement with the engagement holes 23*a*. As shown in FIG. 1, the engagement pawls 11*a*, 12*a* and 13*a* are arranged in a zigzag-shaped pattern as viewed from one side, and the engagement pawls 11*a* and 12*a* are received in recesses 24 and 25 formed through a wall of the rear holder receiving chamber 23. For example, provided that the rear holder 10 is fitted to the F connector 20 while the M surface of the latter erroneously faces to the same, the M surface of the rear holder 10 collides against the end surface of each terminal receiving chamber 22 for cables each having a large diameter, resulting in the rear holder 10 failing to be fitted to the F connector 20.

As is apparent from the above description, a main object of the rear holder 10 resides in preventing the terminals from being disconnected from the F connector 20 after the rear holder 10 is fitted to the rear holder receiving chamber 23, and, moreover, preventing the terminals from being incorrectly inserted into the corresponding terminal receiving chambers while they are thrust through the F surface of the rear holder 10.

Figure 3:
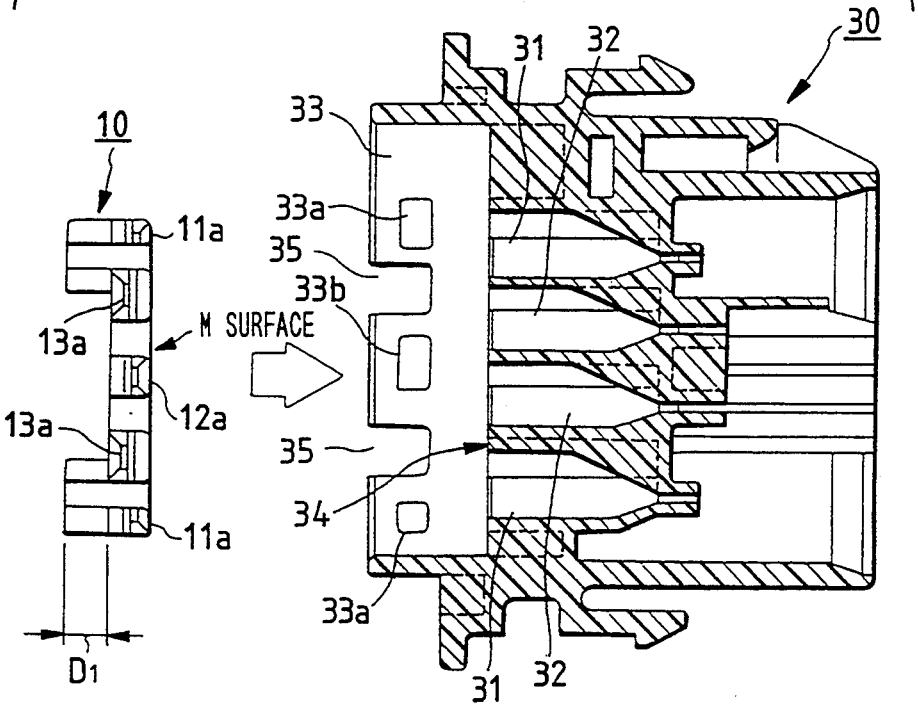
FIG. 3 is a sectional view of the rear holder shown in FIG. 1, particularly illustrating how the rear holder is fitted to a male connector housing.

Next, with the M connector 30 shown in FIG. 3 adapted to cooperate with the F connector 20 in the form of a pair, a plurality of terminal receiving chambers 31 for receiving terminals for cables each having a small diameter and a plurality of terminal receiving chambers 32 for receiving terminals for cables each having a large diameter are formed in the M connector 30 adapted to cooperate with the F connector 20 in the form of a pair. A common end surface 34 of the terminal receiving chambers 31 and 32 is kept flat, and a rear holder receiving chamber 33 is formed at a rear end part of the M connector 30 with the common end surface 34 as a bottom surface.

After terminals having cables connected thereto are inserted into the terminal receiving chambers 31 and 32, the M surface of the rear holder 10 prepared in a form of a flat surface in a same manner as the common end surface 34 is fitted to the rear holder receiving chamber 33 while the M surface faces the common end surface 34. Subsequently, the engagement pawls 11*a* and 12*a* formed at the foremost ends of the partition pieces 11 and 12 are brought in engagement with engagement holes 33*a* and 33*b* formed through a wall of the rear holder receiving chamber 33, whereby the rear holder 10 is fixedly secured to the M connector 30. At this time, the engagement pawls 13*a* of the partition pieces 13 are received in recesses 35 formed through the wall of the rear holder receiving chamber 33.

Consequently, the rear holder 10 exhibits a function of properly arranging respective cables in a side-by-side relationship in the form of a row of cables, a function of preventing terminals from being disconnected from the M connector 30 in the rearward direction, and a function of correcting incomplete insertion of the respective terminals in the same manner as the case where the rear holder 10 is fitted to the F connector 20.

Since the rear holder 10 is designed such that it includes on one side thereof stepped parts each having a contour corresponding to that of the rear end part of the relevant connector but the surface of the rear holder 10 is kept flat on the other side, it can be used for both the F connector 20 and the M connector 30 each of which has a different contour at the rear end part.

The aforementioned embodiment of the present invention has been described above with respect to the case that the rear holder is employed for a so-called hybrid connector. However, the present invention should not be limited to this type of connector. It is obvious that the present invention can equally be applied to an ordinary connector having the same terminals received therein. In this case, the rear holder is fitted to the connector while a specific surface of the rear holder always faces a rear end part of the connector.

Figure 4:
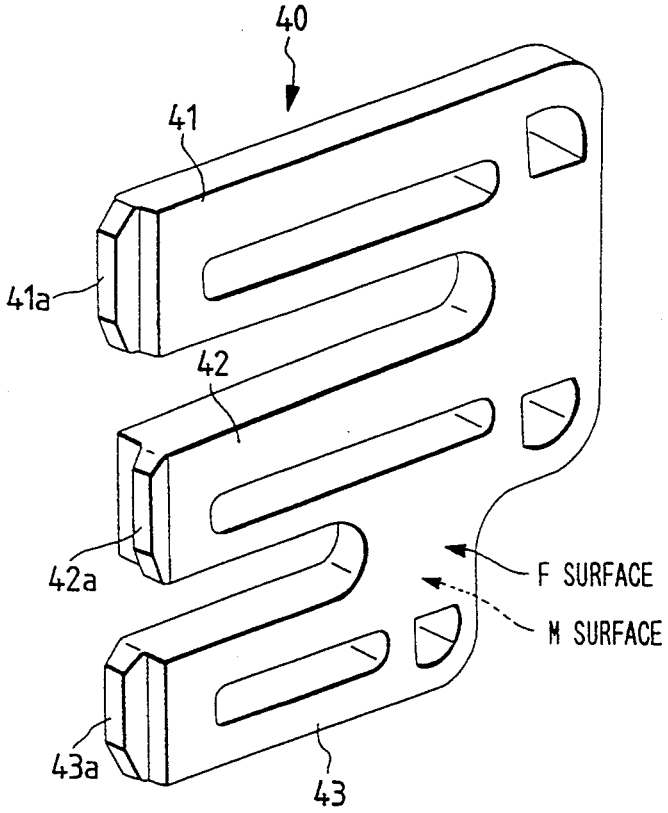
FIG. 4 is a perspective view of a rear holder for a connector constructed according to another embodiment of the present invention.

FIG. 4 is a perspective view of a rear holder constructed according to another embodiment of the present invention wherein the rear holder is employable for a connector having a special contour. The rear holder 40 is designed in a flat plate-shaped configuration corresponding to the special contour of the connector. The rear holder 40 includes three partition pieces 41, 42 and 43 which are projected from a base portion in a leftward direction, and engagement pawls 41*a* , 42*a* and 43a are formed at a foremost ends of the partition pieces 41, 42 and 43, respectively. On the assumption that one side of the rear holder 40 is referred to as an F surface and an opposite side of the same is referred to as an M surface, the rear holder 40 can be used for both an F connector and an M connector to cooperate with each other in the form of a pair by fixedly securing the rear holder 40 to the F connector with the aid of the engagement pawl 42*a* , while the F surface faces the F connector, and moreover, by fixedly securing the rear holder 40 to the M connector with the aid of the engagement pawls 41*a* and 43*a* while the M surface faces to the M connector.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. A rear holder for preventing terminals from being disconnected from a female connector housing or a male connector housing, comprising:

a base;

a plurality of partition pieces extending from said base and corresponding to an arrangement of terminal receiving chambers in said female connector housing or said male connector housing, adjacent partition pieces defining spaces therebetween in which cables associated with said terminals are received;

wherein a first surface of said holder has a contour which is coincident with that of a rear end part of said female connector housing; and a second, opposite, surface of said holder has a contour which is coincident with that of a rear end part of said male connector housing such that said rear holder can be fitted to said rear end part of said female connector housing with Said housing or to said rear end part of said male connector housing connector housing.

2. A rear holder for a connector as claimed in claim 1, further comprising engagement pawls formed at foremost ends of said partition pieces.

3. A rear holder for a connector as claimed in claim 2 wherein said engagement pawls correspond to a row of engagement holes formed in a wall of said female connector housing or said male connector housing.

4. A rear holder for a connector as claimed in claim 2 wherein said engagement pawls are arranged in a zigzag-shaped pattern.

5. A rear holder for a connector as claimed in claim 1 wherein said first surface is flat and said second surface contour has a stepped portion.

6. A rear holder for a connector as claimed in claim 1 wherein at least one of said first surface and said second surface is flat.

7. A rear holder for a connector as claimed in claim wherein at least one of said first surface and said second surface has a stepped portion.

8. A rear holder for a connector as claimed in claim wherein said first surface is a rear surface and said second surface is a front surface.

9. The rear holder of claim 1, wherein said rear holder includes at least three of said partition pieces so as to define at least two slots, one of said slots being dimensioned to receive a cable of a predetermined diameter and another one of said slots being differently dimensioned to receive another cable having a diameter smaller than said predetermined diameter.-.

* * * * *